US010794141B2

(12) United States Patent
Haug et al.

(10) Patent No.: US 10,794,141 B2
(45) Date of Patent: Oct. 6, 2020

(54) RISERLESS LIGHT WELL INTERVENTION CLAMP SYSTEM, CLAMP FOR USE IN THE SYSTEM, AND METHOD OF RISERLESS INTERVENTION OR ABANDONMENT OF A SUBSEA WELL FROM A FLOATING INSTALLATION

(71) Applicant: FMC Kongsberg Subsea AS, Kongsberg (NO)

(72) Inventors: Fred-Olav Haug, Holmestrand (NO); Jan Reidar Andenes, Jar (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 16/063,245

(22) PCT Filed: Dec. 15, 2016

(86) PCT No.: PCT/EP2016/081119
§ 371 (c)(1),
(2) Date: Jun. 15, 2018

(87) PCT Pub. No.: WO2017/102907
PCT Pub. Date: Jun. 22, 2017

(65) Prior Publication Data

US 2018/0371863 A1 Dec. 27, 2018

(30) Foreign Application Priority Data

Dec. 15, 2015 (NO) ..... 20151710
Jul. 7, 2016 (NO) ..... 20161129

(51) Int. Cl.
*E21B 19/00* (2006.01)
*E21B 19/12* (2006.01)
(Continued)

(52) U.S. Cl.
CPC ..... *E21B 33/076* (2013.01); *E21B 19/002* (2013.01); *E21B 19/12* (2013.01); *E21B 33/072* (2013.01); *E21B 41/0007* (2013.01)

(58) Field of Classification Search
CPC ..... E21B 19/002; E21B 19/12; E21B 33/072; E21B 33/076; E21B 41/0007
See application file for complete search history.

(56) References Cited

U.S. PATENT DOCUMENTS 3,638,722 A 2/1972 Talley, Jr.
4,838,522 A * 6/1989 Calkins ..... B66C 13/02 212/259

(Continued)

FOREIGN PATENT DOCUMENTS

JP 62280167 A * 12/1987
WO WO 02/079607 A1 10/2002
WO WO 2004/106695 A1 12/2004

*Primary Examiner* — Matthew R Bucks

(57) ABSTRACT

The invention relates to a system, a clamp, and an associated method, for riserless intervention or abandonment of a subsea well (40), the system comprising means for lowering and/or retrieval of wire line tools (19) or equipment from a surface facility (18) to a subsea location, the system comprising: a Pressure Control Head (2) having an internal through-going bore for receiving a wire line (16), wherein the Pressure Control Head (2), during use, allows access to the subsea well (40) for the wire line and serves as a barrier when the wire line (16) and wire line tool (19) is nm into and out of the subsea well (40), a clamp (17) connected to the PCH (2), a wire line tool (19) connected to the wire line (16), and wherein the clamp (17) is adapted to clamp around or being released from the wire line (16) such that lowering and/or retrieving of the Pressure Control Head (2) and the wire line tool (19) is performed using the wire line (16).

13 Claims, 8 Drawing Sheets

(51) Int. Cl.

| | |
|---|---|
| ***E21B 33/072*** | (2006.01) |
| ***E21B 33/076*** | (2006.01) |
| ***E21B 41/00*** | (2006.01) |

(56) References Cited

U.S. PATENT DOCUMENTS

| | | | | |
|---|---|---|---|---|
| 4,844,210 | A * | 7/1989 | Wong | E21B 19/10 188/65.1 |
| 4,986,360 | A * | 1/1991 | Laky | E21B 19/22 166/351 |
| 6,609,571 | B2 * | 8/2003 | Nice | E21B 33/076 166/241.5 |
| 6,733,203 | B2 * | 5/2004 | Carlsen | F16G 11/048 403/365 |
| 7,549,476 | B2 * | 6/2009 | Carlsen | E21B 33/076 166/344 |
| 8,047,295 | B2 * | 11/2011 | Skeels | E21B 33/076 166/348 |
| 8,387,701 | B2 * | 3/2013 | Sbordone | E21B 33/076 166/338 |
| 9,435,178 | B2 * | 9/2016 | Xu | E21B 34/066 |
| 2013/0098632 | A1 | 4/2013 | Wetzel et al. | |

* cited by examiner

RISERLESS LIGHT WELL INTERVENTION CLAMP SYSTEM, CLAMP FOR USE IN THE SYSTEM, AND METHOD OF RISERLESS INTERVENTION OR ABANDONMENT OF A SUBSEA WELL FROM A FLOATING INSTALLATION

The invention relates to a system for riserless intervention or abandonment of a subsea well, a clamp for use in the system, and a method of riserless intervention or abandonment of a subsea well from a floating installation.

BACKGROUND OF THE INVENTION

Traditional well interventions in subsea wells have been conducted using drilling rigs and workover riser systems. This is time consuming and requires costly drilling rigs to perform the operations.

Therefore, a Riserless Light Well Intervention (RLWI) stack has been developed, with a subsea lubricator to optimize this type of subsea well intervention. The RLWI stack can be run from an intervention vessel without the use of a workover riser or a conventional marine riser. Riserless Light Well Intervention (RLWI) stacks are known in the art. Such systems are used when performing inspection and maintenance of subsea wells, i.e. without using a riser (i.e. "Riserless operations"). This is normally performed by inserting downhole tools into the well under full pressure by the use of wireline. Such methods reduce the cost per operation by 40 to 60% compared to the cost for performing well intervention on subsea wells when using full scale drilling rigs and traditional equipment.

The last several years of operating RLWI in the North Sea were valuable toward making this technology viable for deeper waters in other regions. Mark II contains many components with a water depth rating of 10,000 ft (3,048 m) and the significant improvements made from Mark I to Mark II all focus on operations in deeper waters. One issue that remains is the surface vessel. As the Mark II technology becomes customized for deeper waters, winch and umbilical reel sizes must increase. In turn, load capacity requirements must be increased so that in the end, heave compensation equipment power requirements must increase five-fold.

The RLWI Stack normally comprises a Well Control Package (WCP) connected to a X-mas tree, a Lubricator Section (LS), and a Pressure Control Head (PCH) that is installed in parallel with the wireline tools. All operations are controlled from the Tower Cabin, organized by a Vessel Superintendent. The RLWI Stack is easily adaptable to any existing subsea production system on the market.

In particular, the installation of the Pressure Control Head (PCH) is time consuming and involves using a dedicated PCH Running Tool. If a tool is to be installed into the well, the tool and the PCH typically need to be lowered simultaneously using two wires, one wire lowering the tool and another wire lowering the PCH, which wires are operated by one crane each, respectively. In addition, the lowering operation from the floating installation and down to the seabed system needs to be monitored using a Remotely Operated Vehicle (ROV) or similar. This process is time consuming and requires a lot of people involved for simultaneously operations. In addition, the maximum highest possible lowering and retrieving velocity is typically 25 meters/minute. At significant water depths, ranging from hundreds to up to several thousands of meters water depth, 25 meters/min (or even less) is a significant factor with regard to the overall time used in the operation.

The Pressure Control Head (PCH) is attached on top of the lubricator and serves as a pressure barrier by sealing the well bore during wireline operations, allowing intervention access to wells under pressure. The Pressure Control Head (PCH) normally represents the primary seal when the wireline is run into the well. Alternatively, it may serve as an additional seal, such as a secondary, tertiary seal etc. The seal around moving wireline is performed by pumping viscous grease between the limited free space in the wireline and the narrow tubes in the PCH. A grease injection system, which is located in the Lower Lubricator Package (LLP), supplies the grease pressure that must always be higher than the wellhead pressure. A tool catcher may be located at the bottom of the PCH with the function of catching and holding the tool if the tool string is unintentionally pulled into the PCH and the wireline is broken.

The PCH normally has the following attributes:

Operational setup: flow tubes in PCH are chosen based on cable dimensions and shut in well head pressure, Grease injection forms a liquid grease seal around the moving Wire Line, The PCH is installed together with wire line tool and seals off the lubricator, The PCH is installed by a dedicated Running Tool (PCH Running Tool).

It is an objective of the present invention to overcome the drawbacks in the prior art solutions.

More specifically, an objective of the invention is to provide a system which does not require a dedicated ROV for lowering and/or retrieving of the Pressure Control Head (PCH) and the tool from topside down to the seabed, and from the seabed back to the surface/topside.

Another objective of the invention is to increase the lowering and retrieving velocity of the Pressure Control Head (PCH) and the tool from topside to the seabed, and from the seabed back to the surface.

A further objective is to reduce the required man-power topside, thereby reducing cost, e.g. by using only one crane (wire-line winch) topside for both the Pressure Control Head (PCH) and the tool.

SUMMARY OF THE INVENTION

According to the present invention, a clamp or hang off device is mounted around a Pressure Control Head (PCH) for lowering and retrieval of the PCH. The clamp grips around the wire line cable and holds the weight of the PCH and possible other parts of the RLWI Stack (this depends on total weight and properties of the wire line cable). The basic principle of the invention is thus, instead of using a dedicated running tool for the Pressure Control Head (PCH) (and possible other elements of the RLWI Stack), to mount or form a clamp or hang off device onto the PCH or, alternatively as an integral part of the PCH, for lowering and retrieval of the PCH. The clamp grips around the wire line cable and holds the weight of the PCH and possibly other parts of the RLWI Stack (this depends on total weight and properties of the wire line).

The Pressure Control Head normally represents the primary seal when the wireline is run into the well. Alternatively, it may serve as an additional seal, such as a secondary seal, a tertiary seal etc.

The operation sequence when the PCH and well operation tool has been lowered to the seabed may comprise the following:

The PCH will be located at a pre-determined distance from the well operation tool and run subsea clamped to the wire line cable.

The ROV opens the clamp once PCH is landed subsea, allowing the well operation tool to be run into the well.

The ROV will lock the clamp again when the wire line run is completed, the tool positioned correctly and PCH is ready for retrieval.

Throughout the description and claims different words are used for wire, wire line, wireline, lifting wire, well intervention wire/wireline etc. which all are intended to have the same meaning, i.e. any wire which runs from a surface location at a floating installation and is suitable for lowering any tools or PCH down to a subsea well.

The present invention has at least the following advantages compared to prior art solutions:

Eliminates one lifting line in the water and thus one crane at the surface/topside.

Higher installation speed can be achieved when running only the wire line winch compared to operating two winches in parallel.

No risk of entanglement of lines during installation.

Reduces potential risk for down time.

Eliminates retrieval and installation of running tool.

Large drift off or large belly on wire line cable during installation caused by strong currents can be reduced by the extra weight the PCH introduces. If using two or more wires in parallel, as in the prior art solutions, the different wires and equipment may move differently in the water due to waves and currents. I.e. heavy equipment and or wire will be less influenced by waves and currents than lighter equipment, thus resulting in that the wire line tool and the PCH may move relative each other in a vertical direction with the potential risk of entanglement or collision. The additional drag forces introduced by the PCH structure can reduce, and sometimes even eliminate, this effect.

Self-locking function (e.g. if exposed to outside contact or similar, then the system is adapted to apply an additional clamping force).

Significant reduction of time spent in lowering and retrieving of the PCH and well operation tool (velocity increased from 25 meters/minute to 60 meters/minute).

The wire line tool, i.e. any well operation tool suitable to be run with a wire line, typically hangs 2-3 meters below the lowermost part of the PCH. The wire line tool is normally maximum 16 meters, which under most operating conditions does not involve any problem in lowering the tool into and through the lubricator because the lubricator is 22 meters. However, if the tool is longer than approximately 16 meters, the distance between the bottom of the PCH and the tool has to be reduced.

The wire line tool is normally of such a mass and dimension that there is no risk of collision between the tool hanging below the PCH and the PCH itself, during installation or lowering, and retrieval.

According to the present invention, a system for riserless intervention or abandonment of a subsea well is described, the system comprising means for lowering and/or retrieval of tool and equipment from a surface facility to a subsea location, the system comprising:

a Pressure Control Head having an internal through-going bore for receiving a wire line, wherein the Pressure Control Head, during use, allows access to the subsea well for the wire line and serves as a barrier when the wire line and wire line tool are run into and out of the subsea well, a clamp connected to the Pressure Control Head, the wire line tool is connected to the wire line, and wherein the clamp is adapted to clamp around or be released from the wire line such that lowering and/or retrieving of the Pressure Control Head and the wire line tool is performed using the wire line. Thus, the same single wire line is used both for lowering and retrieving the PCH and the wire line tool.

According to an aspect of the system, the clamp may be arranged as an integral part of the Pressure Control Head, and the wire line tool may be arranged below the Pressure Control Head during lowering and/or retrieval of the Pressure Control Head and the wire line tool.

Alternatively, the clamp may be a separate part relative the Pressure Control Head, and the clamp may have connection means for connection to the Pressure Control Head. The clamp may be connected to the Pressure Control Head by using e.g. flanges arranged in an upper part and a lower part of the clamp, respectively.

In an aspect of the system, the clamp may comprise a first locking element and a second locking element, the first and second locking elements being adapted to move within respective first and second housings, wherein:

a movement of the respective first and/or second locking element in a direction towards said respective first or second housing forces the clamp to enter an energized position where an inner diameter of a through-going bore of the clamp is reduced relative a de-energized position and the clamp thereby clamps around the wire line, and a movement of the respective first or second locking element in the opposite direction away from said respective first or second housing forces the clamp to enter a de-energized position where the inner diameter of the through-going bore is increased relative the energized position and the clamp is retracted relative the wire line thereby allowing unobstructed movement of the wire line relative the clamp.

According to an aspect of the system, the first and second locking elements may be cone-shaped and the respective first and second housings may have complementary internal cone-shapes. It is obvious that the first and second locking elements and the respective first and second housings may have other complementary shapes than cone-shape, such as wedge-shape, polygonal, pyramidal, etc. The first and second locking element may in one embodiment comprise two or more locking segments, which locking segments together form the locking element. Thus, in the energized position of the clamp, the locking segments are forced into abutment with the neighboring locking segment(s) thereby reducing the diameter of the internal through-going bore, whereas in the de-energized position, the locking segments are forced away from each other thereby increasing the diameter of the through-going bore.

In an aspect, the clamp may further comprise a cam arrangement, wherein the cam arrangement may be arranged such that upon movement of an actuating means in a first direction, an upper and a lower cam rotate on first and second contact surfaces on the first and second locking elements, respectively, and a part of the cams with extension are pointed against first and second interacting surfaces on the first and second locking elements, thus forcing the first and second locking elements in the axial direction into clamping contact with the respective complementary first and second housings, thereby entering the energized position of the clamp.

In an aspect, when the clamp is in the energized position, the clamp may have a dual direction self-locking function wherein upon movement of the wire line in a first direction, the first locking element is forced further towards the corresponding first housing, and wherein upon a movement of the wire line in a direction opposite the first direction, the second locking element is forced further towards the corresponding second housing. The self-locking function works both when exposed to downward and upward influence (lifting/lowering of the wire line, as well as external impact caused by stroke). As a result of downward pull of the wire line, the lower locking element (the second locking element) will be forced further towards the second housing and thus provide an increased clamping force around the wire line. Similarly, as a result of an upward pull on the wire line, the upper locking element (the first locking element) will be forced further towards the complementary second housing and thus provide an increased clamping force around the wire line.

In an aspect of the system, the clamp may comprise a force exerting element, which force exerting element is configured to force and retract the first and second locking elements towards and away from the respective first and second housings, thereby operating the clamp between the energized position and the de-energized position.

The force exerting element may comprise a passive element such as a spring arrangement or an active element such as a hydraulic cylinder arrangement. The passive element may, as an alternative to a spring, be a flexible or elastic element adapted to store potential energy which can be released. Alternatively, combinations of passive and active elements (e.g. a combination of the spring and hydraulic cylinder arrangements) may be used.

In an aspect of the system, the clamp may comprises an actuating means configured to operate the force exerting element, wherein the actuating means is operable by a Remotely Operated Vehicle (ROV) or similar.

The invention further relates to a clamp, e.g. for use in the system described above, wherein the clamp has:

an energized position where it engages and clamps around a wire line extending through a through-going bore of the clamp and follows any axial movement of the wire line, and a de-energized position where it is retracted relative the wire line and allows unobstructed movement of the wire line in the through-going bore relative the clamp, and wherein the clamp comprises a first locking element and a second locking element, the first and second locking elements being adapted to move within respective first and second housings, wherein a movement of the respective first or second locking element towards said respective first or second housing forces the clamp to enter the energized position, and a movement of the respective first or second locking element in the opposite direction away from said respective first or second housing forces the clamp to enter the de-energized position.

According to an aspect of the clamp the first and second locking elements may be cone-shaped and the respective first and second housing may have complementary internal cone-shapes.

The clamp may have the following features:

in the energized position, an inner diameter of a through-going bore of the clamp is reduced, and in the de-energized position, the inner diameter of the through-going bore is increased, and wherein the clamp further comprises a cam arrangement, wherein the cam arrangement is arranged such that upon movement of an actuating means in a first direction, an upper and a lower cam rotate on first and second contact surfaces on the first and second locking elements, respectively, and a part of the cams with extension are pointed against first and second interacting surfaces on the first and second locking elements, thus forcing the first and second locking elements towards the respective complementary first and second housings, thereby entering the energized position of the clamp.

The invention further relates to a method of riserless intervention or abandonment of a subsea well from a floating installation, comprising:

preparing a wire line through a Pressure Control Head, wherein the Pressure Control Head, during use, serves as a barrier when the wire line and any wire line tool are run into and out of the subsea well, connecting a wire line tool to the wire line, clamping the Pressure Control Head to said same wire line using a clamp, and running the wire line tool and the Pressure Control Head from the floating installation to a subsea location on said same wire line, and when at position at the subsea well, opening the clamp to allow the wireline to run through the clamp and Pressure Control Head unobstructed.

According to an aspect of the method, when the operation in the well is finished, the method may further comprise:

running the wire line tool to a retrieval position, activating the clamp to clamp around the wire, and retrieving the wireline, wireline tool, PCH and clamp with the wire line to the floating installation, i.e. surface.

The operation uses the wire line for installation of tools for well operations, which wireline is also utilized for lowering and retrieving the PCH. Thus, there is no need for a dedicated running tool when using the clamp system. It is to be understood that the different terms used for wire, wire line, wire line cable, wireline etc. shall be understood as having the same meaning, i.e. any cable capable of lowering or retrieving and installing tools or components used as part of a RLWI Stack or used together with a RLWI Stack.

The invention relates to the implementation of a clamp in the PCH that will grip on the wire line and make the PCH follow the wire line up and down. When the well operation tool is lowered to the desired position, the clamp is adapted to be released whenever it is desired.

Alternatively, and not part of the invention, in order to provide for contingency, e.g. in emergency situations, or if the weight of the tool and PCH is too heavy for a single wire, the clamp may be provided with an interface for dedicated running tool on top of the clamp.

It is obvious that the clamp according to the method can be the same clamp as in relation to the system described in details above, and that features of the clamp according to the method can be varied in similar ways as for the system.

These and other characteristics of the invention will be clear from the following description of a preferential form of embodiment, given as a non-restrictive example, with reference to the attached drawings wherein:

BRIEF DESCRIPTION OF THE DRAWINGS

FIG. 4D is a detailed view of section F in FIG. 4C;

DETAILED DESCRIPTION OF A PREFERRED EMBODIMENT

Figure 1A:
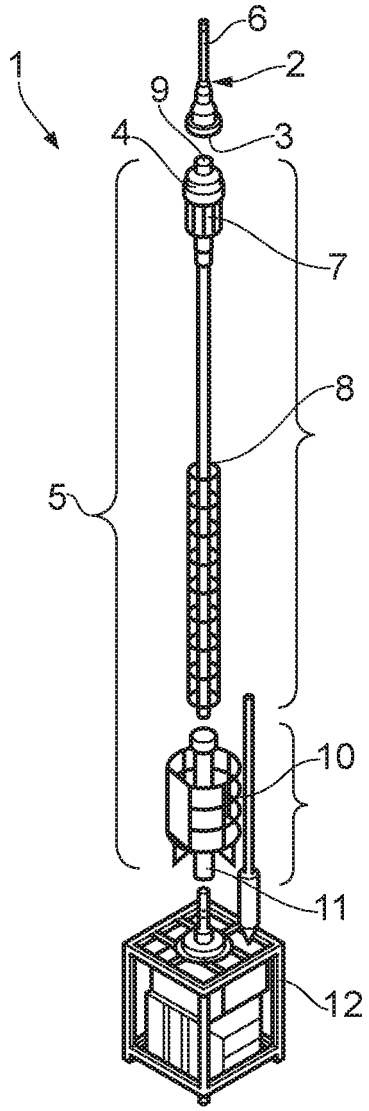
FIG. 1A (Prior Art)
FIG. 1A discloses a typical prior art well intervention setup and the components forming part of a RLWI Stack.

FIG. 1A discloses a typical prior art well intervention setup and the components forming part of a RLWI Stack 1. A Pressure Control Head (PCH) 2 is arranged on top of the RLWI Stack 1 and contains the ULP connector 9 on top of the Lubricator Section (LS) 5, for attachment to the Pressure Control Head (PCH) hub 3, and the sealing section 6 with the flow tubes sealing off the intervention wire (not shown) from the wellbore pressure below and the open water above.

The Upper Lubricator Package (ULP) 7 is mounted on top of the Lubricator Tubular (LT) 8, and contains the wire line cutting ball valve, the circulation outlet, and the ULP connector 9 towards the PCH hub 3 on the PCH 2. The Lubricator Tubular (LT) 8 is mounted on top of the Lower Lubricator Package (LLP) 10 and carries the grease reservoirs and the high-pressure grease injection pumps. When well intervention tools are placed in the lubricator 5 and the lubricator 5 is pressurized to wellbore pressure, tools may be conveyed into the wellbore under live well pressure. The Lower Lubricator Package (LLP) 10 has a Lower Lubricator Package connector 11 to connect the LLP 10 to a Well Control Package (WCP) 12, in a known manner.

Figure 1B:
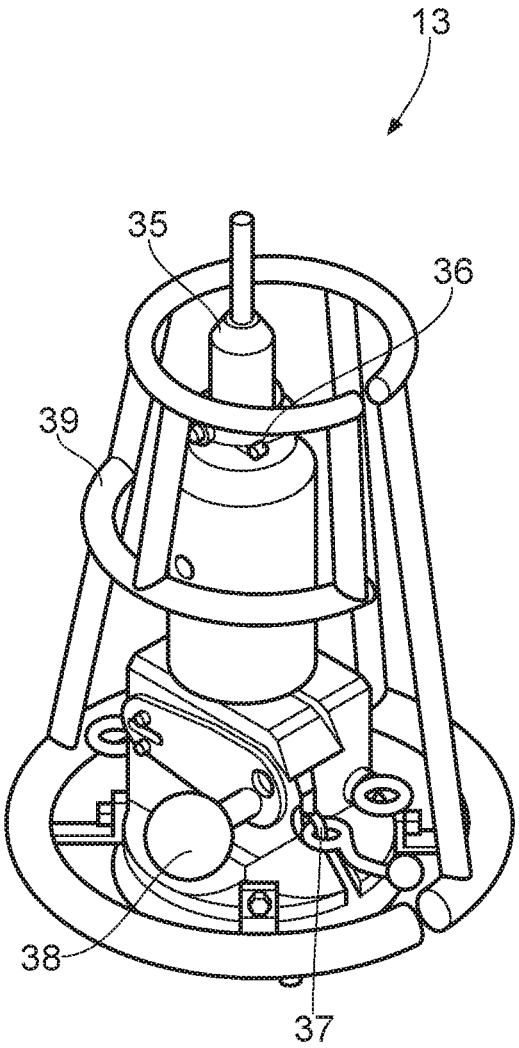
FIG. 1B (Prior Art)
FIG. 1B shows typical prior art running tools used for installation of the different components forming the RLWI Stack.

FIG. 1B shows a typical prior art running tool used for installation of the different components of the RLWI Stack (Mark II). It is common to perform lowering and retrieving of the components forming the RLWI Stack 1 using dedicated running tools. The Figure shows a prior art Guide Line Less Running Tool (GLL RT) 13. The GLL RT 13 in FIG. 1B was one of the first PCH Running tools that did not require dedicated guidewires in addition to the lifting wires in the lowering and retrieving operations. As is clear from the Figure, the GLL RT 13 has a protective structure 39, a lifting interface 35, a feed-through for wireline cable 36 and a secondary lock pin 37 which secures the lock/unlock handle 38 in lock position. The GLL RT 13 is guided using a ROV which secures the GLL RT 13 in place. However, using the GLL RT 13 in FIG. 1B would still require separate lifting wires for the Pressure Control head 2 (lifted by the GLL RT 13) and the wire line tool (not shown in FIG. 1B).

Figure 2:
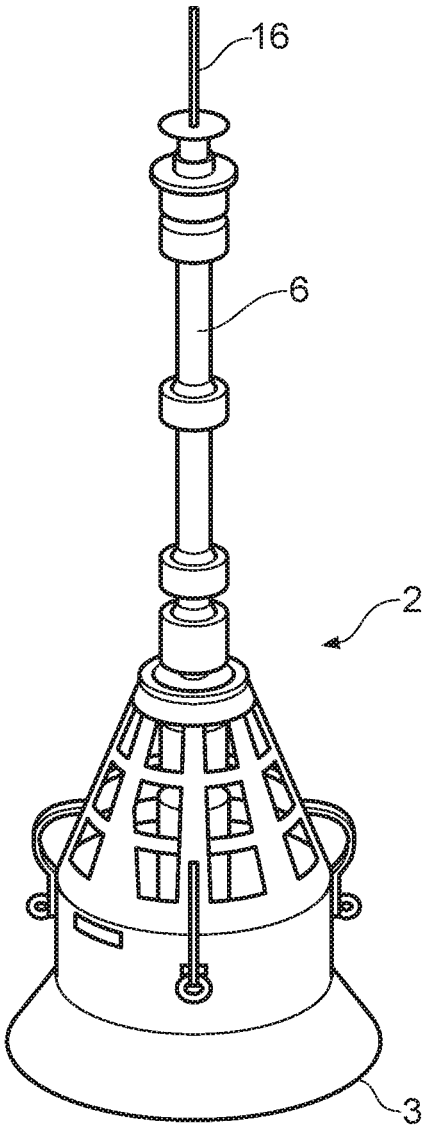
FIG. 2 (Prior Art)
FIG. 2 shows details of a prior art Pressure Control Head (PCH)

FIG. 2 shows details of a prior art Pressure Control Head (PCH) 2. The Pressure Control Head (PCH) 2 is constructed such that it may be arranged on top of the RLWI Stack and contains the PCH hub 3 for attachment to the top 4 of the Lubricator Section (LS) 5 (see details in FIG. 1A), and the sealing section 6 with the flow tubes (inside the sealing section), sealing off the intervention wire line 16 from the wellbore pressure below and the open water above.

Figure 3:
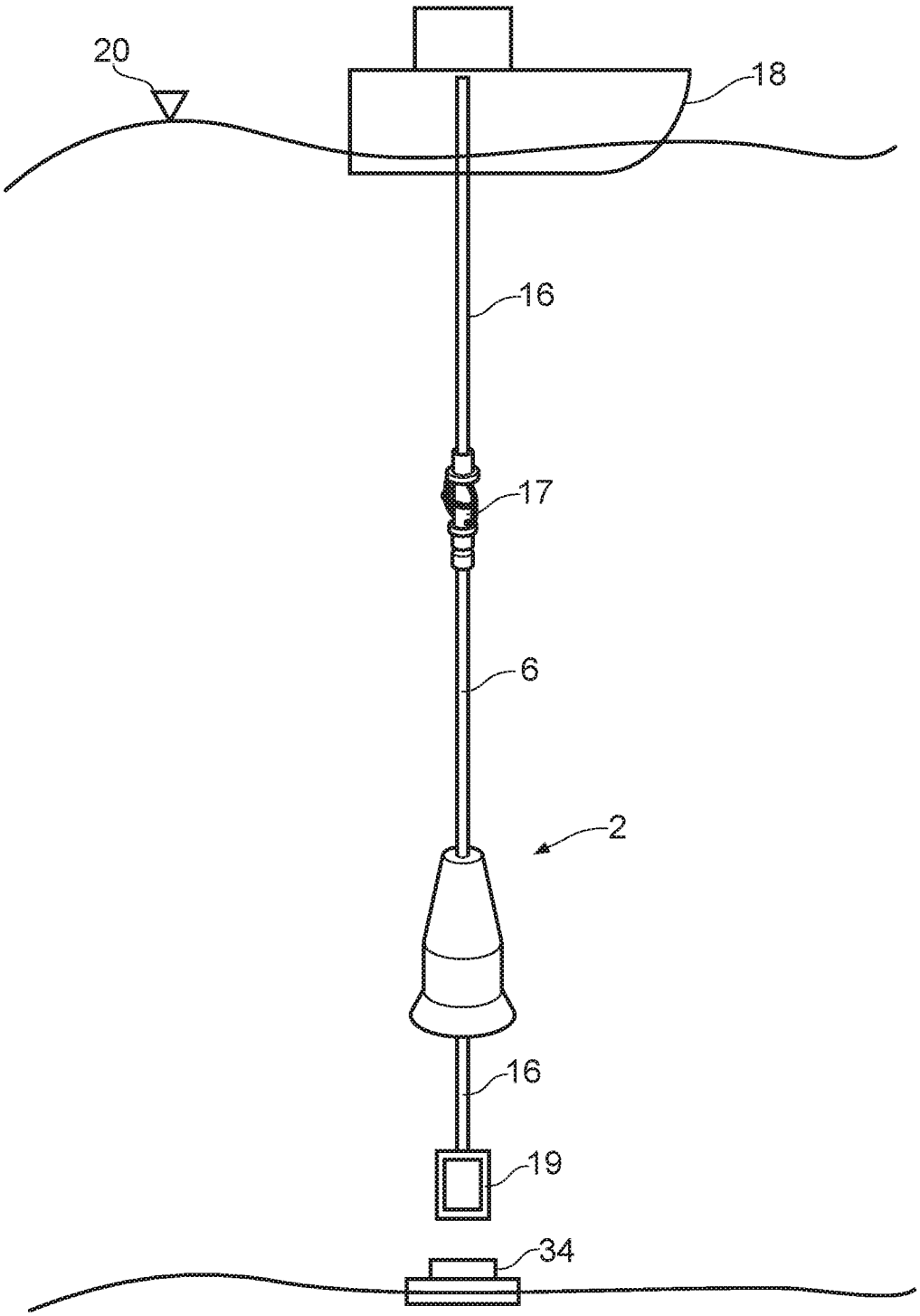
FIG. 3 shows an example of a system for riserless intervention or abandonment of a subsea well according to the invention, the system comprising means for lowering and/or retrieval of equipment from a surface facility to a subsea location.

FIG. 3 shows an example of a system for riserless intervention or abandonment of a subsea well 34 according to the invention. A floating vessel 18 is floating on a water surface 20. The floating vessel 18 comprises normal light well intervention equipment such as crane(s), Intervention workover control systems (IWOCS), pressure control equipment operable to close or shutdown valves and wireline in case of emergency, umbilical disconnect, etc. A single intervention wire line 16 runs from the floating vessel 18 down to the pressure control head (PCH) 2 and further down to a wire line tool 19. The same single wire line 16 runs all the way from the floating vessel 18 to the well operation tool 19 via the Pressure Control Head (PCH) 2. The Pressure Control Head (PCH) 2 is clamped to the wire line 16 using a clamp 17. The clamp 17 provides for the possibility of lowering and retrieving/lifting the Pressure Control Head (PCH) 2 and the wire line tool 19 using a single wire line 16. Features of the clamp 17 will be discussed in more detail below. The clamp 17 may be formed as an integral part of the Pressure Control Head 2 or as a separate part relative the Pressure Control Head. If the clamp 17 is a separate part, the clamp 17 may have connection means for connection to the Pressure Control Head.

Figure 4A:
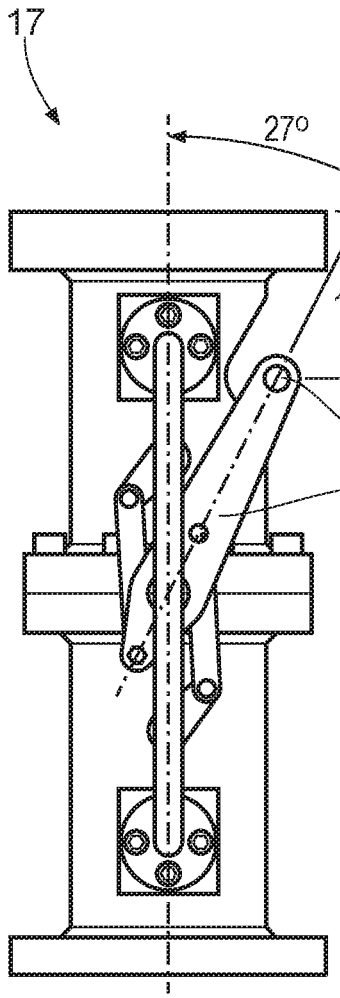
FIGS. 4A and 4B show examples of a clamp according to the present invention in two different side views, in an energized position where the clamp reduces an inner diameter of a through-going bore, through which bore a wire, such as an intervention wire may extend.
Figure 4B:
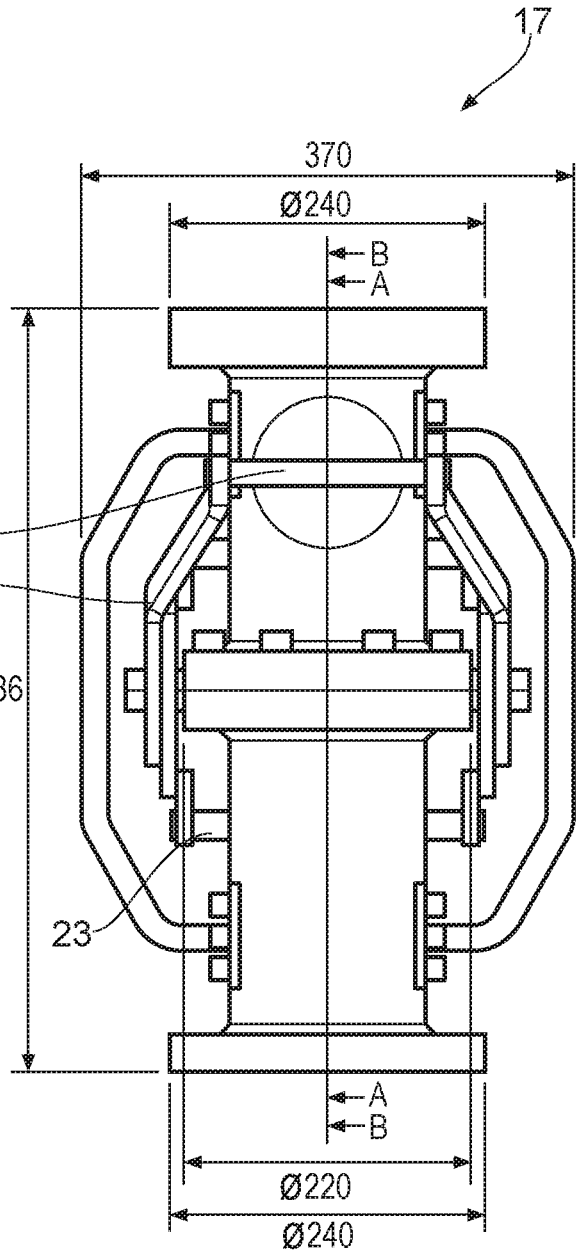

FIGS. 4A and 4B show examples of a clamp 17 according to the present invention in two different side views, in an energized position where the clamp 17 reduces an inner diameter of a through-going bore, through which bore a wire line 16, such as an intervention wire, a wireline etc., may run.

Figure 4C:
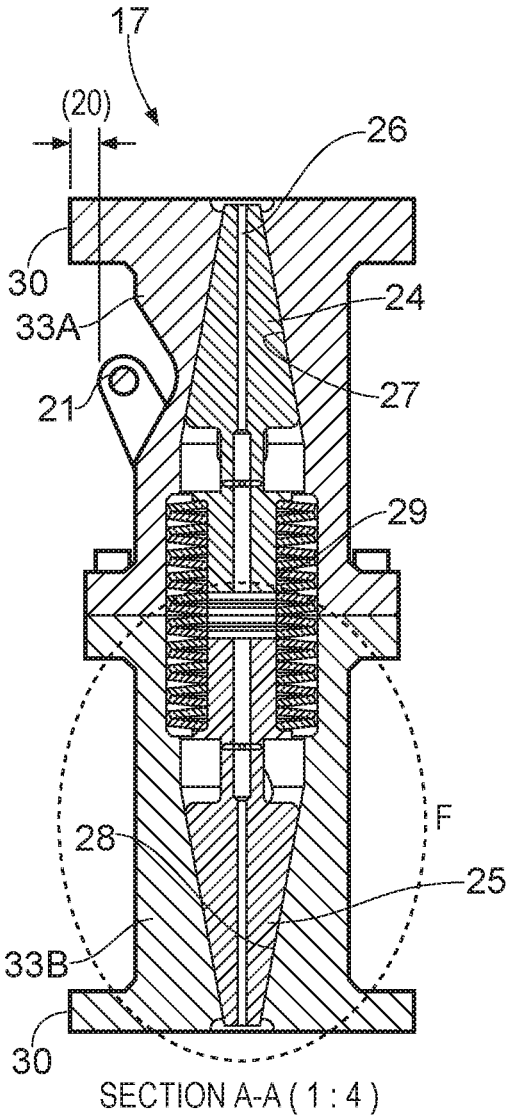
FIGS. 4C and 4D show details of the locking function of the clamp in energized position, disclosed in FIGS. 4A and 4B, where
Figure 4D:
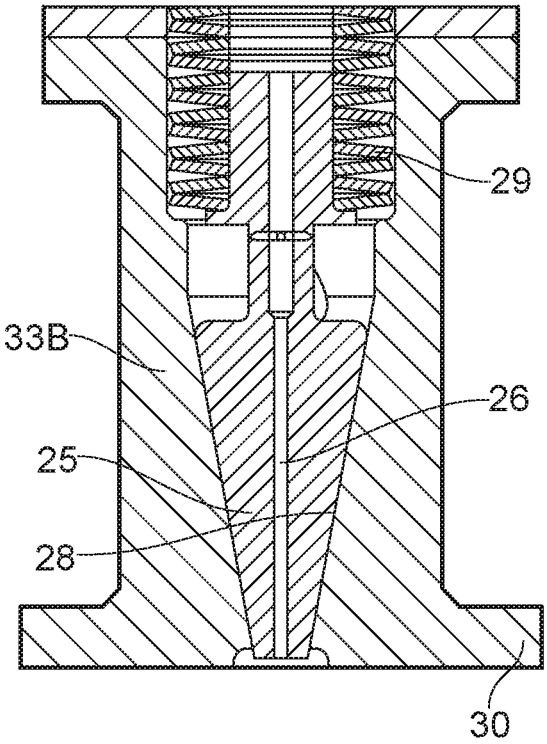

FIGS. 4C and 4D show details of the locking function of the clamp disclosed in FIGS. 4A and 4B, where FIG. 4D is a detailed view of section F in FIG. 4C.

Figure 4E:
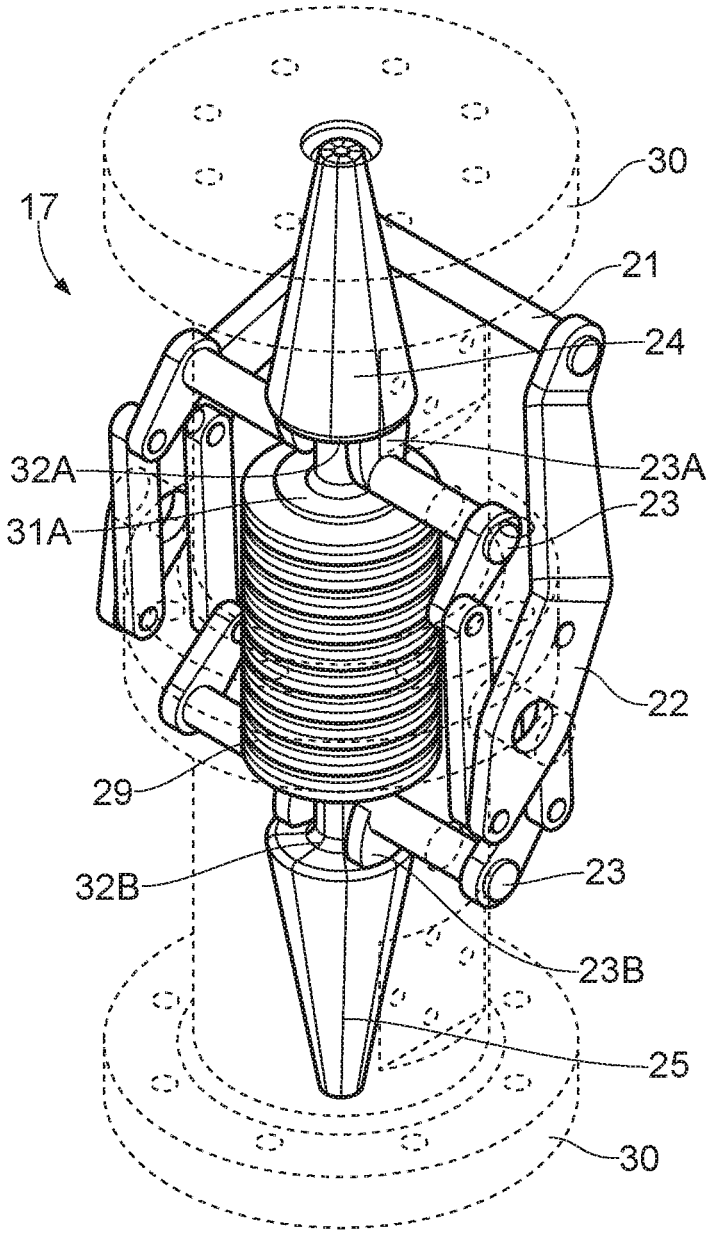
FIGS. 4E and 4F show details of the functional setup of the interface for the clamp for movement between the energized position and the de-energized position, and vice versa.
Figure 4F:
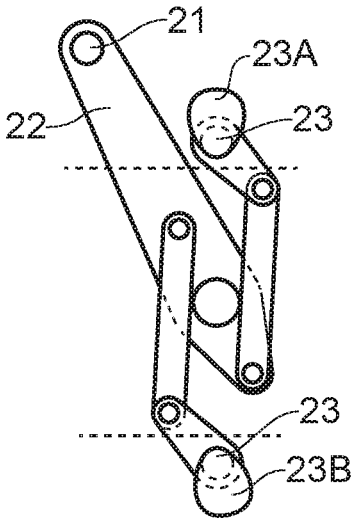

FIGS. 4E and 4F show details of the functional setup of the interface for the ROV friendly clamp to move the clamp between the energized position and the de-energized position, and vice versa.

Figure 4G:
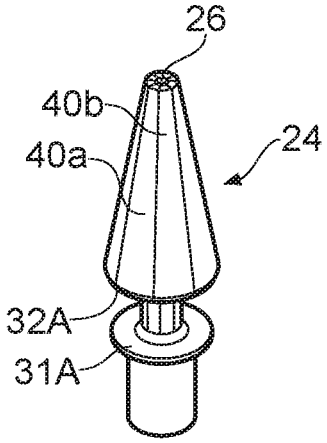
FIG. 4G shows details of an embodiment of a first locking element.

FIG. 4G shows details of an embodiment of a first locking element 24 and a first surface 31A, a first interacting surface 32A and an opening leading to a through-going bore 26 of the clamp, as well as locking segments 40*a*, 40*b* which locking segments together form the locking element 24. The locking segments 40*a*, 40*b* together form the first locking element 24. Thus, in the energized position of the clamp, the locking segments 40*a*, 40*b* are forced into abutment with each other, thereby reducing the diameter of the internal through-going bore 26, whereas in the de-energized position, the locking segments 40*a*, 40*b* are forced away from each other, thereby increasing the diameter of the through-going bore 26.

Figure 4H:
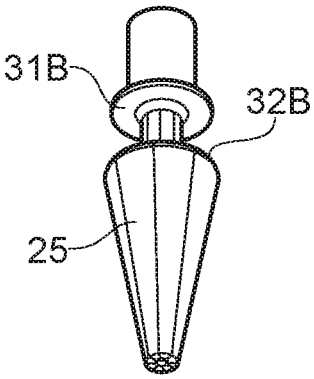
FIG. 4H shows details of an embodiment of a second locking element.

FIG. 4H shows details of an embodiment of a second locking element 25 and a second surface 31B, a second interacting surface 32B and an opening leading to a through-going bore 26. The second locking element 25 may also be formed by locking segments 40*a*, 40*b* as described above in relation to the first locking element 24.

With reference to FIGS. 4A-4F, the clamp 17 has an energized position where it engages and clamps around a wire line 16 and follows any axial movement of the wire line 16, and a de-energized position where the clamp 17 is retracted relative the wire line 16 and allows unobstructed movement of the wire line 16 relative the clamp 17 (and relative the Pressure Control Head 2, to which the clamp 17 is connected). The clamp 17 is provided with actuating means 21, for example handles operable by Remotely Operated Vehicles (ROV) (not shown) or similar, configured to actuate first and second locking elements (see details on FIGS. 4C-4D, elements 24, 25) to operate the clamp between the energized position and the de-energized position and vice versa. The actuating means 21 is connected to a locking arrangement for increasing or reducing an inner diameter of a through-going bore (FIG. 4C, 4D, element 26) extending through the clamp 17. The actuating means 21 is in mechanical connection, via a rod arrangement 22 and a cam arrangement 23 (details on FIGS. 4E and 4F), to a first locking element 24 and a second locking element 25. The first locking element 24 and the second locking element 25 can move within respective first and second housings 27 and 28. The first and second locking elements 24, 25 may have a cone-shape, and the first and second housings 27, 28 may have complementary internal cone-shapes, such that movement of the respective locking element 24, 25 towards the respective housing 27, 28 forces the clamp 17 to enter the energized position, i.e. a position where the inner diameter of the through-going bore 26 is reduced relative the de-energized position, and a movement of the respective locking element 24, 25 in an opposite direction away from said respective housing 27, 28 forces the clamp 17 to enter the de-energized position, i.e. where the inner diameter of the through-going bore 26 increases relative the energized position.

The cam arrangement 23 is arranged such that upon movement of the actuating means into the energized position of the clamp (best shown in FIGS. 4E and 4F), the upper and lower cams 23A, 23B will rotate on the first and second contact surfaces 31A, 31B on the first and second locking elements 24, 25, respectively. When in the energized position, the parts of the cams 23A, 23B with extension (i.e. parts 23A; 23B in the drawings) are pointed against first and second interacting surfaces 32A, 32B on the first and second locking elements 24, 25, thus forcing the first and second locking elements 24, 25 towards the respective complementary first and second housings 27, 28.

The first and second housings 27, 28 are formed in the first and second outer fixed elements 33A, 33B, respectively of the clamp 17, which first and second outer fixed elements 33A, 33B have a fixed axial extension, i.e. they are not extendable and are bolted to each other. Consequently, the first and second outer fixed elements 33A, 33B and thus the first and second housings 27, 28 will not move when the clamp 17 enters the energized position, and hence the first and second locking elements 24, 25 will move relative the first and second housings 27, 28 when the clamp 17 is moved between the energized position and the de-energized position and vice versa.

Similarly, when moving the clamp 17 from the energized position to the de-energized position, the actuating means 21 is operated such that the parts of the cams 23A, 23B with extension are rotated relative the first and second contact surfaces 31A, 31B; thus the first and second locking elements 24, 25 are moved towards each other (i.e. away from the respective first and second housings 27, 28), and thus forced out of contact with the respective complementary first and second housings 27, 28. Then the parts of the cams 23A, 23B with extension are rotated by the actuating means 21 such that they are pointing towards the first and second contact surfaces 31A, 31B, respectively, working against the force of the force exerting element 29, and finally locking the clamp 17 in the de-energized position. The parts of the cams 23A, 23B with extension may be formed with a curved part and a flat part, such that they may easily be rotated on the curved part while they are "locked" when the flat part abuts the first and second contact surfaces 31A, 31B. In one embodiment, the force on the first and second locking elements 24, 25 by the actuating means 21 operated by an ROV are larger than the force exerted by the force exerting element 29, thus holding the clamp 17 in the de-energized position, and allowing unobstructed movement of the wire line 16 through the clamp 17.

It is clear from FIG. 4C, when the clamp 17 is in the energized position, the clamp 17 has a dual direction self-locking function, wherein upon movement of the wire line 16 in a first direction, i.e. upward movement of the wire line 16, the first locking element 24 is forced further towards the corresponding first housing 27, thereby providing additional clamping force around the wire line 16, and similarly, upon a movement of the wire line 16 in a direction opposite the first direction, i.e. downward movement of the wire line 16 with weight on the wire line, the second locking element 25 is forced further towards the corresponding second housing 28, thereby providing additional clamping force around the wire line 16.

The first and second locking elements 24, 25 may be connected to a force exerting element 29, e.g. a passive element such as a spring arrangement or an active element such as a hydraulic cylinder arrangement or any other means capable of pushing or forcing the first and second locking elements 24, 25 upwardly and downwardly, respectively, by actuation of the actuating means 21 by a ROV. I.e. the force exerting element 29 is configured to force the first and second locking elements towards and away from the complementary internal cone-shaped first and second housing 27, 28, respectively, thereby operating the clamp 17 between the energized position and the de-energized position.

The clamp 17 may be connected to the Pressure Control Head (PCH) 2 by using e.g. the flanges 30 arranged in an upper part and of a lower part of the clamp 17, respectively.

Figure 5A:
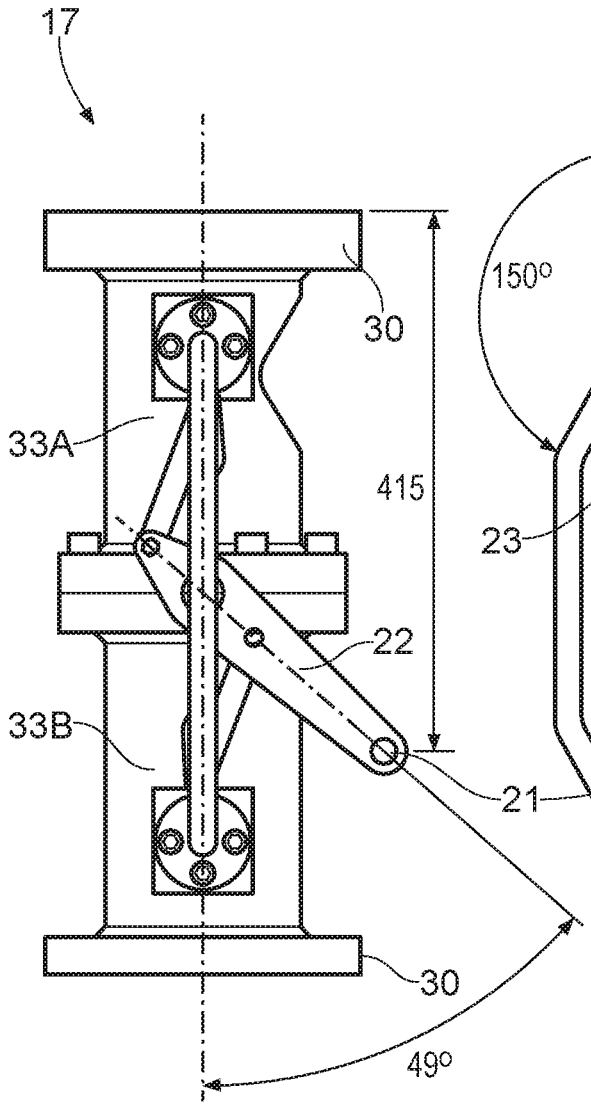
FIGS. 5A and 5B show details of the locking function of the clamp when the clamp is in a de-energized position where it is not clamping the wire.
Figure 5B:
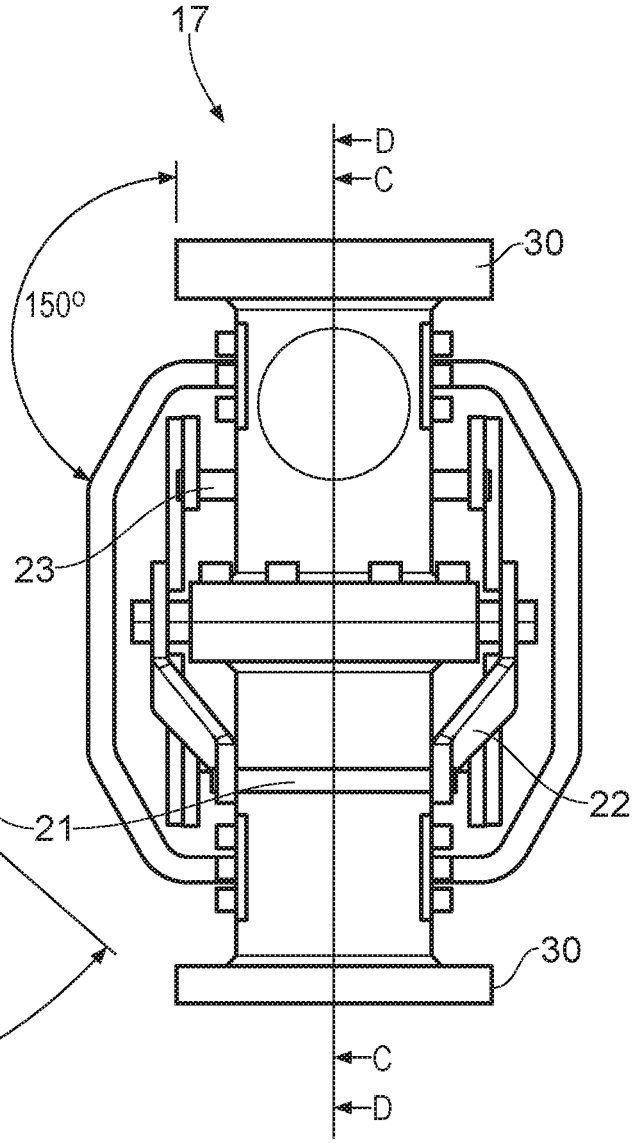

FIGS. 5A and 5B show details of the locking function of the clamp when the clamp is in a de-energized position where it is not clamping the wire.

Figure 5C:
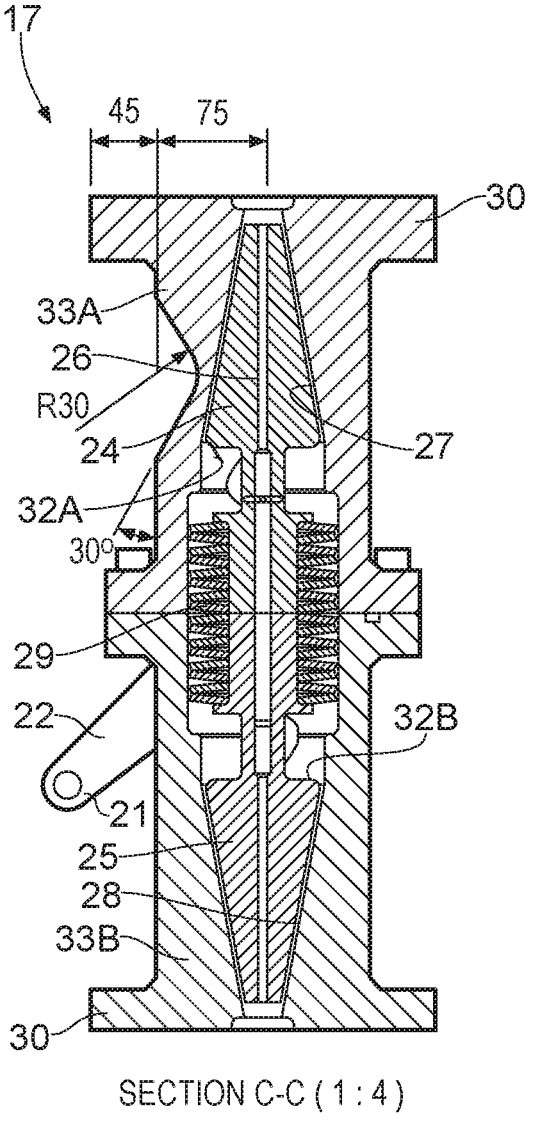
FIGS. 5C, 5D and 5E show details of the functional setup of the interface for the clamp in the de-energized position.
Figure 5D:
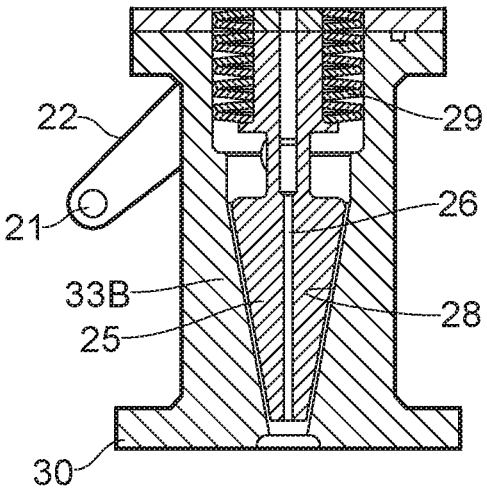
Figure 5E:
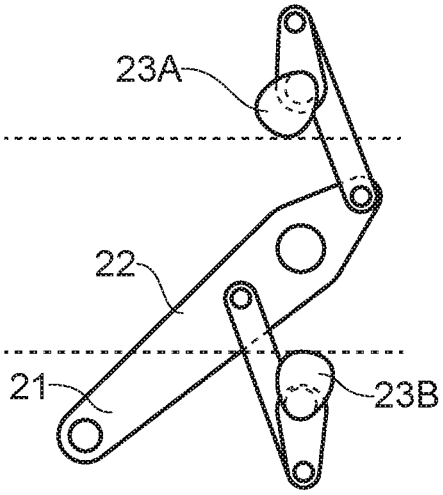

FIGS. 5C, 5D and 5E show details of the functional setup of the interface for the clamp for movement between the de-energized position and the energized position, and vice versa.

When comparing FIG. 5E (clamp in de-energized position) and FIG. 4F (clamp in energized position) it is clear that when the clamp 17 is in the energized position, the parts of the cams 23A, 23B with extension (i.e. parts 23A, 23B in the drawings) are oriented away from the first and second contact surfaces 31A, 31B on the first and second locking elements 24, 25 providing no force against the force exerting element 29; thus the force exerting element 29 forces the first and second locking elements 24 towards the respective complementary first and second housings 27, 28.

However, when looking closer on FIG. 5E, it is clear that the parts of the cams 23A, 23B with extension (i.e. parts 23A, 23B in the drawings) are oriented towards the first and second contact surfaces 31A, 31B on the first and second locking elements 24, 25, thus forcing the first and second locking elements 24, 25 in the axial direction towards each other working against the force exerting element 29. Thus, the first and second locking elements 24, 25 are forced away from, i.e. out of clamping contact with, the respective complementary first and second housings 27, 28, thereby increasing the diameter of the inner bore 26. As is clear from FIGS. 5C and 5D, there is clearly shown a gap between the first locking element 24 and the first housing 27 as well as between the second locking element 25 and the second housing 28, respectively. In this de-energized position, any wire line 16 extending through the through-going bore 26 in the clamp 17 is free to move relative the clamp, i.e. the clamp 17 (and any connected Pressure Control Head (PCH) 2) does not follow the movement of the wire line 16. Due to the fact that the first and second housings 27, 28 form part of the outer housing of the clamp 17, and have a fixed axial extensions, the first and second housing 27, 28 will not move when the clamp 17 enters the energized position, and hence the first and second locking elements 24, 25 will move relative the first and second housings 27, 28 when the clamp 17 is moved between the energized position and the de-energized position, and vice versa. Hence, it is the complementary shapes on the first and second locking elements 24, 25 relative the first and second housing 27, 28 that provide for the locking function of the clamp because the diameter of the through-going opening 26 is reduced or increased. Hence, increased drag forces upwardly on the wire line 16 will tighten the connection between the first locking element 24 and the first housing 27 (the first locking element 24 will move towards the first housing 27), and hence further reduce the diameter of the through-going bore 26 because the first locking element 24 will be forced towards the complementary first housing 27, thereby increase the clamping force on any wire line 16 extending through the trough-going bore 26.

An operational sequence may include preparing a wire line 16 and guiding the wire line 16 through a Pressure Control Head 2, wherein the Pressure Control Head 2, during use, allows access to the subsea well 34 for a wire line and serves as a barrier when the wire line 16 and any wire line tool 19 are run into and out of the subsea well 34. The steps of the method may comprise: connecting a wire line tool 19 to the wire line 16, clamping the Pressure Control Head 2 to said same wire line 16 using a clamp 17, and running the wire line tool 19 and the Pressure Control Head 2 from the floating installation 18 to a subsea location on said same wire line 16.

An operational sequence of the inventive method of riserless intervention or abandonment of a subsea well 34 from a floating installation 18, may comprise: preparing a wire line 16 through a Pressure Control Head 2, wherein the Pressure Control Head 2, during use, serves as a barrier when the wire line 16 and any wire line tool 19 are run into and out of the subsea well 34, connecting a wire line tool 19 to the wire line 16, clamping the Pressure Control Head 2 to said same wire line 16 using a clamp 17, and running the wire line tool 19 and the Pressure Control Head 2 from the floating installation 18 to a subsea location on said same wire line 16, and when at position at the subsea well, opening the clamp 17 to allow the wireline to run through the clamp and pressure control head unobstructed.

When the operation in the well is finished, the method may further comprise: running the wire line tool to a retrieval position, activating the clamp 17 to clamp around the wire line, and retrieving the wire line, wire line tool, PCH and clamp with the wire line to the surface.

It is obvious that the clamp 17 according to the method can be the same clamp as in relation to the system described in details above, and that features of the clamp according to the method can be varied in similar ways as for the system.

The invention provides a solution to the drawbacks of the prior art by providing a method and accompanied system which render possible to lower a Pressure Control Head (PCH) and a well operation tool in a single run using a single lowering means (e.g. wire line etc.).

The invention is herein described in non-limiting embodiments. A person skilled in the art will understand that alterations and modifications to the embodiments may be made that are within the scope of the invention as described in the attached claims.

REFERENCE LIST TO THE DRAWINGS

| | |
|---|---|
| 1 | RLWI Stack |
| 2 | Pressure Control Head, PCH |
| 3 | PCH hub |
| 4 | Top of the lubricator section, LS |
| 5 | Lubricator section, LS |
| 6 | Sealing section of PCH |
| 7 | Upper Lubricator Package (ULP) |
| 8 | Lubricator Tubular (LT) |
| 9 | ULP Connector |
| 10 | Lower Lubricator Package (LLP) |
| 11 | LLP connector |
| 12 | Well Control Package (WCP) |
| 13 | Guide Line Less Running Tool, GLL RT |
| 14 | Lubricator Section Running Tool |
| 15 | Well Control Package Running Tool |
| 16 | Intervention wire |
| 17 | Clamp |
| 18 | Floating vessel |
| 19 | Wire line tool |
| 20 | Water surface |
| 21 | Actuating means, ROV handles |
| 22 | Rod arrangement |
| 23 | Cam arrangement |
| 23A | Upper cam |
| 23B | Lower cam |
| 24 | First locking element |
| 25 | Second locking element |
| 26 | Through-going bore |
| 27 | First housing |
| 28 | Second housing |
| 29 | Force exerting element |
| 30 | Flange |
| 31A | First contact surface |
| 31B | Second contact surface |
| 32A | First interacting surface |
| 32B | Second interacting surface |
| 33A | First outer fixed element |
| 33B | Second outer fixed element |
| 34 | Subsea well |
| 35 | Lifting Interface |
| 36 | Feed-through wire line cable |
| 37 | Secondary lock pin |
| 38 | Lock/unlock handle |
| 39 | Protective structure |
| 40a, b | Locking segment |

The invention claimed is:

1. A system for riserless intervention or abandonment of a subsea well using a wire line tool which is lowered and/or retrieved from a floating vessel to a subsea location, the wire line tool being connected to a wire line during the lowering and/or retrieval, the system comprising:

a Pressure Control Head having an internal through-going bore for receiving the wire line, the Pressure Control Head being configured such that, during use, the pressure control head allows access to the subsea well for the wire line and serves as a barrier when the wire line and wire line tool are run into and out of the subsea well; and a clamp which is connected to the Pressure Control Head;

wherein the clamp is releasably securable to the wire line such that the lowering and retrieval of the Pressure Control Head and the wire line tool are performed using the wire line;

wherein the clamp comprises a first locking element and a second locking element, the first and second locking elements being adapted to move within respective first and second housings; and wherein:

a movement of the respective first or second locking element in a direction towards said respective first or second housing forces the clamp to enter an energized position in which an inner diameter of a through-going bore of the clamp is reduced and the clamp thereby clamps around the wire line; and a movement of the respective first or second locking element in the opposite direction away from said respective first or second housing forces the clamp to enter a de-energized position in which the inner diameter of the through-going bore is increased and the clamp is retracted relative the wire line, thereby allowing unobstructed movement of the wire line relative to the clamp.

2. The system according to claim 1, wherein the first and second locking elements are cone-shaped and the respective first and second housings have complementary internal cone-shapes.

3. The system according to claim 1, wherein the clamp further comprises a cam arrangement and means for actuating the cam arrangement, and wherein upon movement of the actuating means in a first direction, upper and lower cam portions of the cam arrangement engage first and second interacting surfaces on the first and second locking elements, respectively, to thereby force the first and second locking elements into clamping contact with the respective complementary first and second housings, thereby entering the energized position of the clamp.

4. The system according to claim 1, wherein when the clamp is in the energized position, the clamp has a dual direction self-locking function such that upon movement of the wire line in a first direction, the first locking element is forced further towards the corresponding first housing, and upon movement of the wire line in a direction opposite the first direction, the second locking element is forced further towards the corresponding second housing.

5. The system according to claim 1, wherein the clamp comprises a force exerting element which is configured to force and retract the first and second locking elements respectively towards and away from the respective first and second housings, thereby operating the clamp between the energized position and the de-energized position.

6. The system according to claim 5, wherein the force exerting element comprises at least one of a passive element or an active element.

7. The system according to claim 5, wherein the clamp comprises actuating means for operating the force exerting element, wherein the actuating means is operable by a Remotely Operated Vehicle (ROV).

8. The system according to claim 1, wherein the clamp comprises a force exerting element which is configured to force the first and second locking elements towards the first and second housings, respectively.

9. The system according to claim 8, wherein the force exerting element comprises a passive element.

10. The system according to claim 9, wherein the force exerting element comprises a spring which is positioned between the first and second locking elements.

11. A clamp for use in a system for riserless intervention or abandonment of a subsea well using a wire line tool which is lowered and/or retrieved from a floating vessel to a subsea location, the wire line tool being connected to a wire line during the lowering and/or retrieval, the clamp comprising:

a through-going bore through which the wire line extends;

an energized position in which the clamp engages and clamps around the wire line and follows any axial movement of the wire line; and a de-energized position in which the clamp is retracted relative to the wire line and thus allows unobstructed movement of the wire line through the through-going bore;

wherein the clamp comprises a first locking element and a second locking element, the first and second locking elements being adapted to move within respective first and second housings such that a movement of the first and or second locking element towards said respective first or second housing forces the clamp to enter the energized position, and a movement of the first or second locking element in the opposite direction away from said respective first or second housing forces the clamp to enter the de-energized position.

12. The clamp according to claim 11, wherein the first and second locking elements are cone-shaped and the respective first and second housing have complementary internal cone-shapes.

13. The clamp according to claim 12, wherein:

the clamp is configured such that, in the energized position of the clamp, an inner diameter of the through-going bore of the clamp is reduced, and in the de-energized position of the clamp, the inner diameter of the through-going bore is increased; and the clamp further comprises a cam arrangement and means for actuating the cam arrangement, and wherein upon movement of the actuating means in a first direction, upper and a lower cam portions of the cam arrangement engage first and second interacting surfaces on the first and second locking elements, respectively, to thereby force the first and second locking elements towards the respective complementary first and second housings, thereby entering the energized position of the clamp.

* * * * *